US006025582A

United States Patent [19]

Kang et al.

[11] Patent Number: 6,025,582

[45] Date of Patent: Feb. 15, 2000

[54] OUTPUT CONTROL FOR A MICROWAVE OVEN, A HOOD DEVICE AND ASSOCIATED LAMP

[75] Inventors: Jeon-hong Kang, Kunpo; Sang-jin Jeong, Suwon, both of Rep. of Korea

[73] Assignee: Samsung Electronics Co., Ltd., Suwon, Rep. of Korea

[21] Appl. No.: 09/084,498

[22] Filed: May 27, 1998

[30] Foreign Application Priority Data

Nov. 6, 1997 [KR] Rep. of Korea ..... 97-58458
Mar. 23, 1998 [KR] Rep. of Korea ..... 98-9898

[51] Int. Cl.[7] ..... H05B 6/68

[52] U.S. Cl. ..... 219/757; 219/758; 219/718; 126/299 R; 126/299 D

[58] Field of Search ..... 219/757, 758, 219/718, 715, 681; 126/299 R, 299 D

[56] References Cited

U.S. PATENT DOCUMENTS

| | | | |
|---|---|---|---|
| 4,143,646 | 3/1979 | Sampsel | 126/299 D |
| 4,198,553 | 4/1980 | Dills | 219/718 |
| 4,591,683 | 5/1986 | Eke | 219/757 |
| 4,647,746 | 3/1987 | Eke | 219/681 |
| 4,886,046 | 12/1989 | Welch | 126/299 D |
| 5,003,141 | 3/1991 | Braunisch et al. . | |
| 5,317,133 | 5/1994 | Sundstrom et al. . | |
| 5,395,453 | 3/1995 | Noda . | |

FOREIGN PATENT DOCUMENTS 9311808 12/1993 Rep. of Korea .

*Primary Examiner*—Philip H. Leung
*Attorney, Agent, or Firm*—Burns, Doane, Swecker & Mathis, L.L.P.

[57] ABSTRACT

A wall type microwave oven having a hood device and an output control method thereof are disclosed. The microwave oven includes a first switch section for switching a power supply to a hood motor of the hood device, and a second switch section for switching power supply to a hood lamp of the hood device. A third switch section controls the output of the microwave oven by several stages. A control section switches/controls the third switch section, responsive to a control of the first or second switch section, such that when the microwave oven is operated with the hood motor or said hood lamp, output of the microwave oven is to be a low level. The output control method includes the steps of operating the microwave oven in a high output mode when an operation command thereto is inputted; turning on a hood lamp or a hood motor when there is an operation command thereto is inputted during an operation of the microwave oven in a high output mode, and switching the microwave oven from a high output mode to a low output mode; turning off the hood lamp or the hood motor when a stop command thereto is inputted during an operation of the microwave oven in a low output mode, and switching the microwave oven from a low output mode to a high output mode; and operating the microwave oven in a low output mode when an operation command thereto is inputted during an operation of the hood lamp or the hood motor. Thus, under the limited installation circumferences, it is possible to design the microwave oven capable of making the utmost use the output of the high voltage transformer and to prevent the overload of the microwave oven.

14 Claims, 6 Drawing Sheets

OUTPUT CONTROL FOR A MICROWAVE OVEN, A HOOD DEVICE AND ASSOCIATED LAMP

BACKGROUND OF THE INVENTION

1. Field of the Invention

The present invention relates to a wall type microwave oven, and more particulary to a wall type microwave oven which is installed on a wall above a gas range, and output control method thereof.

2. Description of the Prior Art

FIG. 1 is a view for explaining an installation of a conventional wall type microwave oven, and FIG. 2 is a view for explaining a construction of a hood device of a conventional wall type microwave oven.

A wall type microwave oven, as shown in FIG. 1, is installed on a wall above a gas range and includes a hood device. As shown in FIGS. 1 and 2, the hood device has a lamp 12 and a hood duct 14 installed at the bottom surface and at right and left sides of a cooking cavity 10, respectively. Also, a hood motor 16 is installed at the middle of rear portion of cooking cavity 10, and a hood fan 18 is installed at both sides of hood motor 16. Accordingly, steam or smoke from gas range is suctioned through hood duct 14, and the suctioned steam or smoke is exhausted to a hood passage 22 formed on wall through a connecting tube 20 by driving of hood fan 18.

Generally, a common-use alternating current (hereinafter AC) power line in home is divided from a distributing board into a lighting wire, a heavy load wire, and a light load wire. The lighting wire is mostly installed along on the ceiling so as to supply the common-use AC power to all the lightings at rooms. The heavy load wire is installed along lower portion of the wall to supply the common-use AC power to the home appliances of large power consumption such as a washing machine, a refrigerator, a television, a stereo system, an electric heater, an iron, and the like. The light load wire is installed along the upper portion of the wall to supply the common-use AC power to the home appliances of relatively small power consumption such as a hood device, a ventilation fan, and the like.

Under the installation of the high output wall type microwave oven having power consumption of more than 1 kW, driving the microwave oven simultaneously with the hood lamp of 80 W, or the hood motor of 150~200 W causes problems such as fuse burnt-out of the distributing board due to overload of light load wire, and supply interruption of the common-use AC power by a circuit interrupter.

Accordingly, since the wall type microwave oven having a hood device is limited to the installation circumstances, it is difficult to design the microwave oven capable of making the utmost use the output of the high voltage transformer.

SUMMARY OF THE INVENTION

The present invention has been made to overcome the above described problem of the prior art, and accordingly, it is an object of the present invention to provide a wall type microwave oven, in which when a hood device is operated at the same time, the microwave oven is operated on a low output mode, and when the microwave oven alone is operated, the microwave oven is operated on a high output mode.

Another object of the present invention is to provide an output control method capable of switching/controlling the output of the wall type microwave oven for allowing the microwave oven to operate on a high output mode.

To achieve above object, the wall type microwave oven having a hood device according to the present invention comprises a section for switching a power supply to a hood motor of the hood device, and a section for switching the output of the microwave oven by several stages. A control section switches/controls the output switch section, responsive to a control of the power supply switch section, so that when the microwave oven is operated with the hood motor, the microwave oven is operated to a low output mode.

Preferably, the wall type microwave oven having a hood device according to the present invention comprises a first switch section for switching a power supply to a hood motor of the hood device, a second switch section for switching a power supply to a hood lamp of the hood device, and a third switch section for controlling the output of the microwave oven by several stages. A control section switches/controls the third switch section, responsive to a control of the first or second switch section, so that when the microwave oven is operated with the hood motor or the hood lamp, the microwave oven is operated to a low output mode.

Here, the third switch section switches the output of the microwave oven to a low or high level by varying winding number of a first coil of a high voltage transformer. Also, the third switch section includes a first relay which is turned on under the high output, and a second relay which is turned on under the low output. One end of the first relay is connected to a middle tap of the first coil of the high voltage transformer, and one end of the second relay is connected to one end of the first coil.

Also, the third switch section includes a double-contact points relay which has each switch contact point for low or high output. The third switch section switches the microwave oven to a high output mode when the microwave oven alone is operated. The control section turns the third switch section to "off" state and the first or second switch section to "on" state, and controls the third switch section such that the microwave oven is switched to a low output mode, when a "turn-on" command to the hood lamp or the hood motor is inputted during an operation of the microwave oven alone.

To achieve the another object of the present invention, an output control method of a wall type microwave oven having a hood device, comprises the steps of:

- operating the microwave oven in a high output mode when an operation command thereto is inputted;
- turning on a hood lamp or a hood motor when there is an operation command thereto is inputted during an operation of said microwave oven in a high output mode, and switching said microwave oven from a high output mode to a low output mode;
- turning off the hood lamp or the hood motor when a stop command thereto is inputted during an operation of said microwave oven in a low output mode, and switching said microwave oven from a low output mode to a high output mode; and
- operating said microwave oven in a low output mode when an operation command thereto is inputted during an operation of the hood lamp or the hood motor.

Accordingly, under the limited installation circumferences of the microwave oven, it is possible to design the microwave oven capable of making the utmost use the output of the high voltage transformer and to prevent the overload of the microwave oven.

BRIEF DESCRIPTION OF THE DRAWINGS

The above object and advantages will be more apparent by describing preferred embodiment in detail with reference to the drawings accompanied, in which.

DETAILED DESCRIPTION OF THE PREFERRED EMBODIMENT

Hereinafter, a preferred embodiment of the present invention will be described in greater detail with reference to the accompanying drawings.

Figure 1:
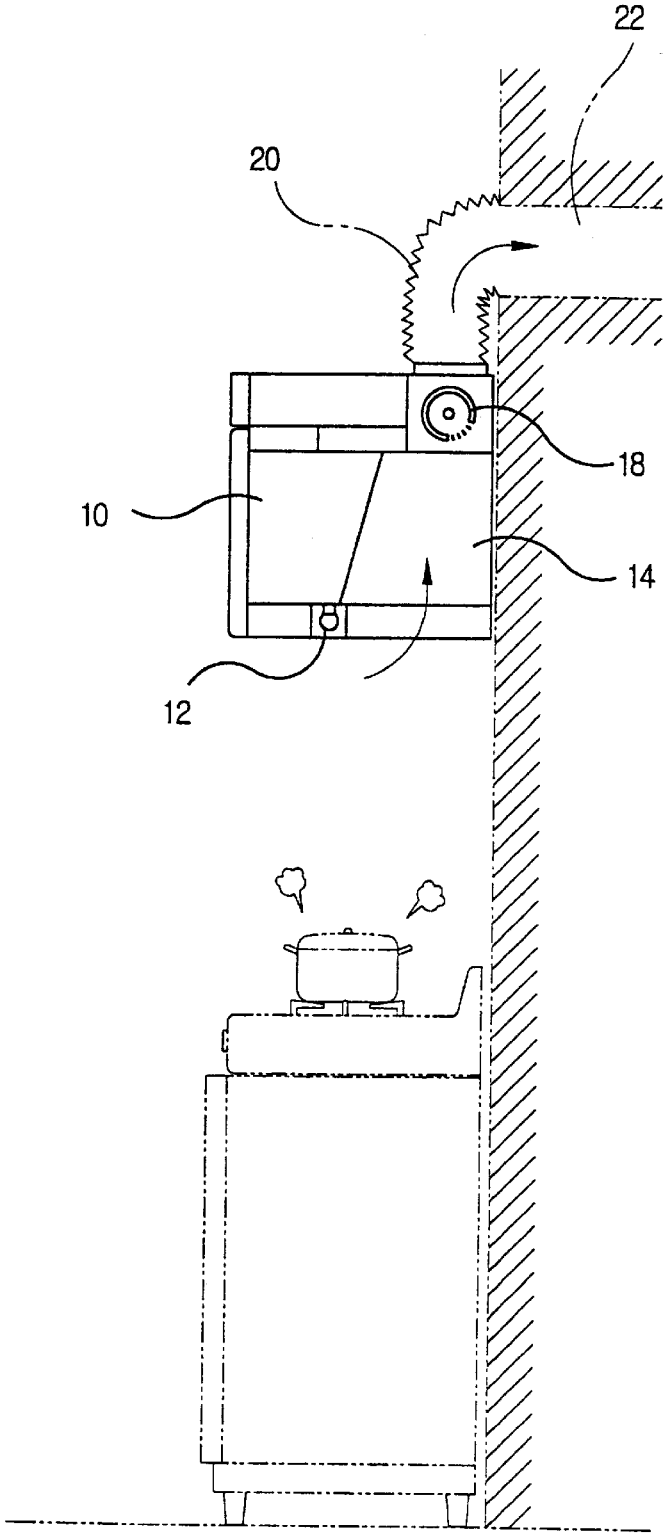
FIG. 1 (PRIOR ART)
FIG. 1 is a view for explaining an installation of a conventional wall type microwave oven.
Figure 2:
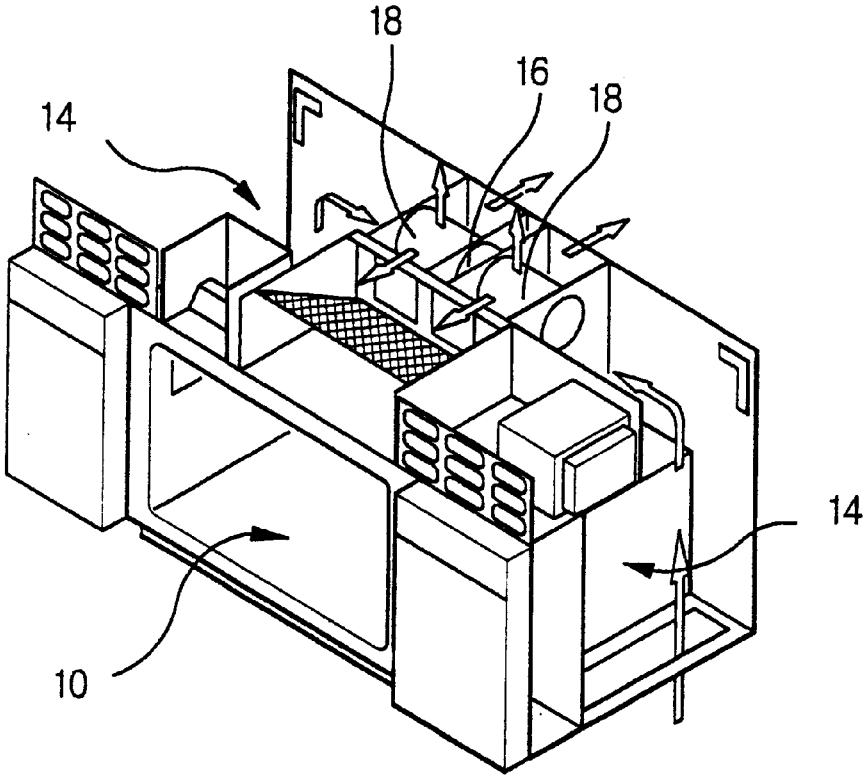
FIG. 2 (PRIOR ART)
FIG. 2 is a view for explaining a construction of a hood device of a conventional wall type microwave oven.
Figure 3:
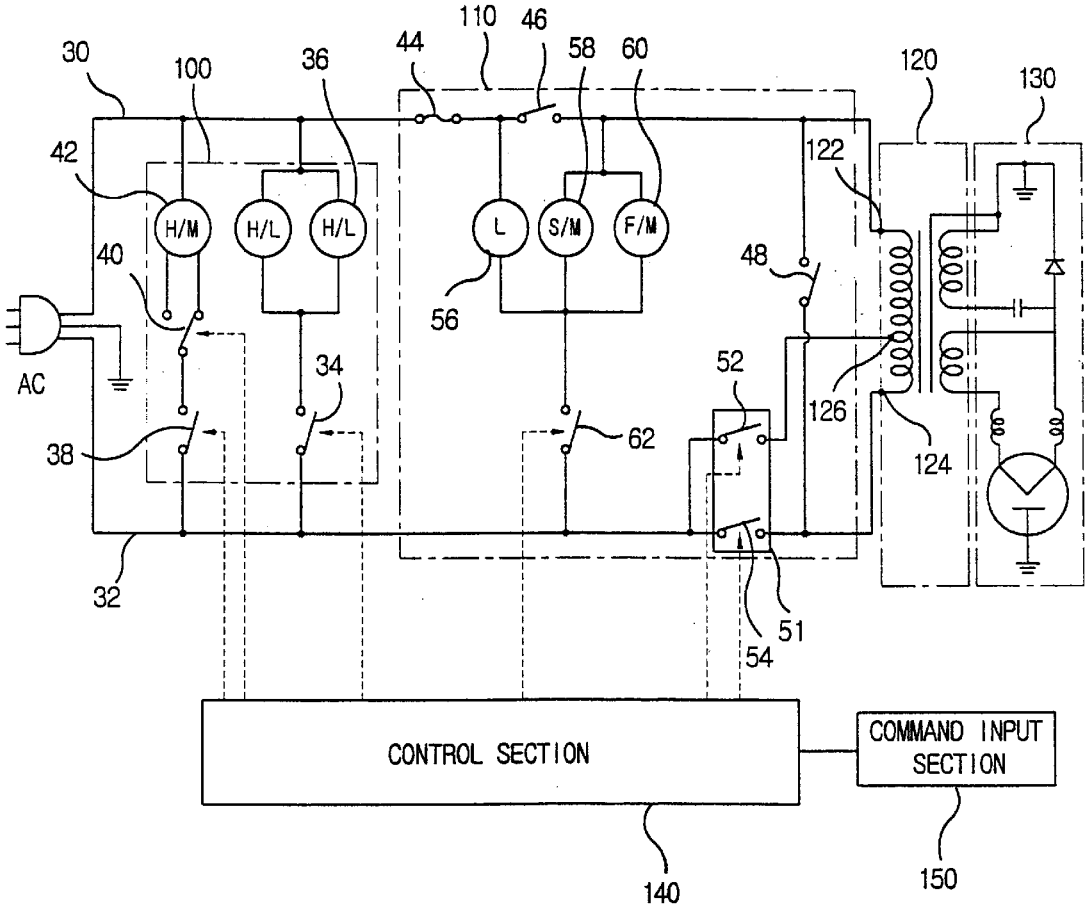
FIG. 3 is a circuit diagram showing a wall type microwave oven according to a preferred embodiment of the present invention.

FIG. 3 is a circuit diagram showing a wall type microwave oven according to a preferred embodiment of the present invention. As shown in FIG. 3, a hood device 100 and a power supply section 110 of the microwave oven are connected in parallel between a first and a second common-use AC power lines 30 and 32. Power supply section 110 controls its power supply to a magnetron driving circuit section 130 through a high voltage transformer 120. A control section 140 controls switching of hood device 100 and power supply section 110, responsive to a command inputted to a command input section 150. Control section 140 obtains an operational voltage from the common-use AC power line through a low voltage transformer (not shown).

Hood device 100 includes a second switch 34 and a hood lamp 36 which are connected serially between first and second AC power lines 30 and 32. Hood device 100 further includes a first switch 38, a strong/weak selection switch 40 and a hood motor 42 which are connected serially between first and second AC power lines 30 and 32. First and second switch 38 and 34 have normally-open contact points which are mostly "off" state and are turned to "on" state, responsive to a switching signal from control section 140. Strong/weak selection switch 40 is normally maintained in a "weak" state, and then turned to a "strong" state, responsive to a switching signal from control section 140. In general, hood lamp 36 is provided as a pair of incandescent electric bulbs of 40 W connected in a parallel circuit.

Power supply section 110 includes a fuse 44 and a first door switch 46 which are connected between first common-use AC power line 30 and one end 122 of a first coil of high voltage transformer 120. An oven lamp 56 and an oven switch 62 are connected between first and second common-use AC power lines 30 and 32. Besides, a stirrer motor 58 and a fan motor 60 are connected in parallel between a common connecting point of oven lamp 56 and oven switch 62, and one end of first door switch 46.

A third switch 51 includes a first relay 52 which is connected between second common-use AC power line 32 and a middle tap 126 of the first coil of high voltage transformer 120, and a second relay 54 which is connected between second common-use AC power line 32 and the other end of the first coil of high voltage transformer 120. Further, third switch 51 includes a monitor switch 48 which is connected between both ends of the first coil of high voltage transformer 120. Preferably, monitor switch 48 is provided behind third switch 51.

First door switch 46 goes "off" when the door of cooking cavity (not shown) is open, and "on" when it is closed. Monitor switch 48 goes "off" when the door of cooking cavity (not shown) is open, and "on" when it is closed. In third switch 51, first relay 52 normally maintains "off" state and is turned "on" in a high output mode, while second relay 54 normally maintains "off" state and is turned "on" in a low output mode (i.e, overload prevention mode).

Table 1 shows "on"/"off" state of first, second and third switch 34, 38 and 51 according to the operation of the microwave oven.

TABLE 1

| division | | switch | | | |
|---|---|---|---|---|---|
| | | | | third switch | |
| | | first switch | second switch | first relay | second relay |
| operation command to microwave oven | high output mode | off | off | off→on | off |
| operation command to hood lamp/hood motor during microwave oven operation | switching from high output mode to low one | off→on | off→on | on→off | off→on |
| operation command to microwave oven during hood lamp/hood motor operation | low output mode (overload prevention mode) | on | on | off | off→on |
| stop command to hood lamp/hood motor during low output mode | switching from low output mode to high one | on→off | on→off | off→on | on→off |

Figure 4:
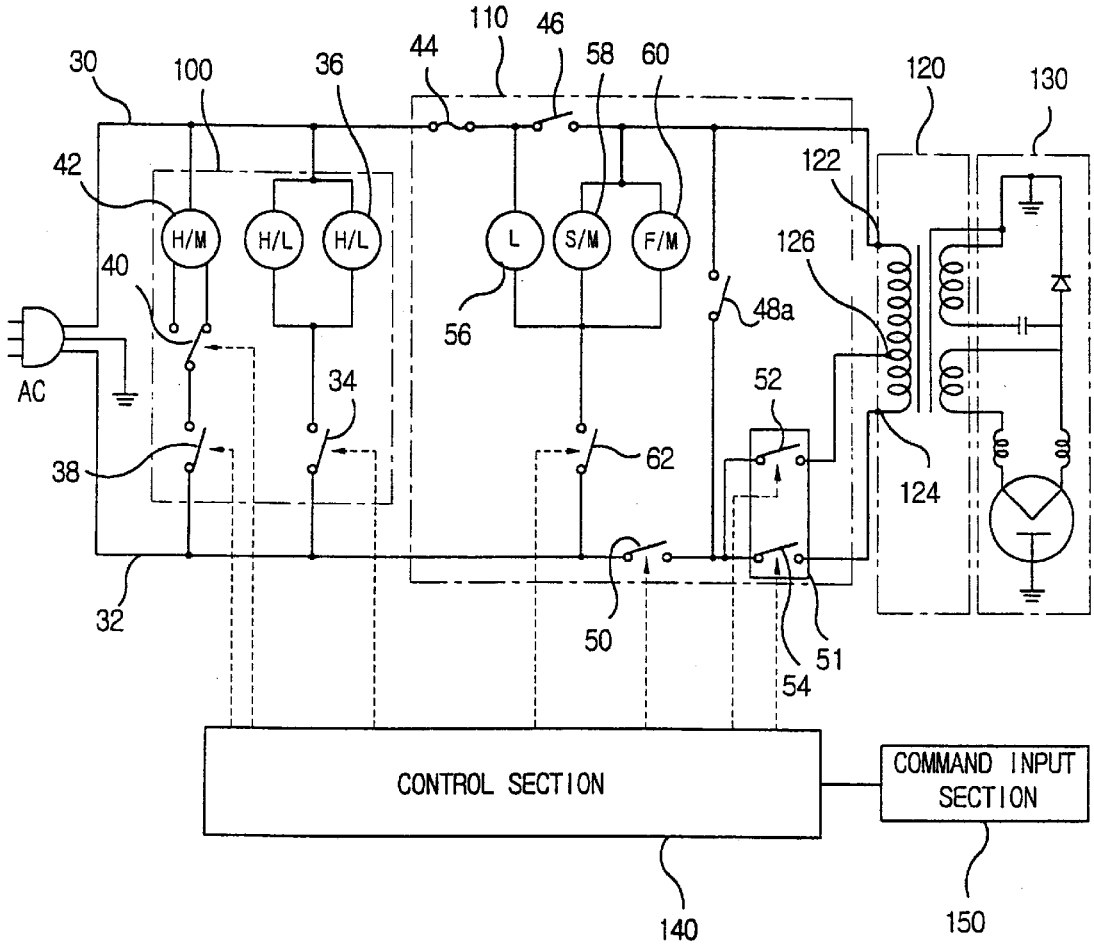
FIGS. 4 and 5 are circuit diagrams showing wall type microwave ovens according to another preferred embodiments of the present invention.
Figure 5:
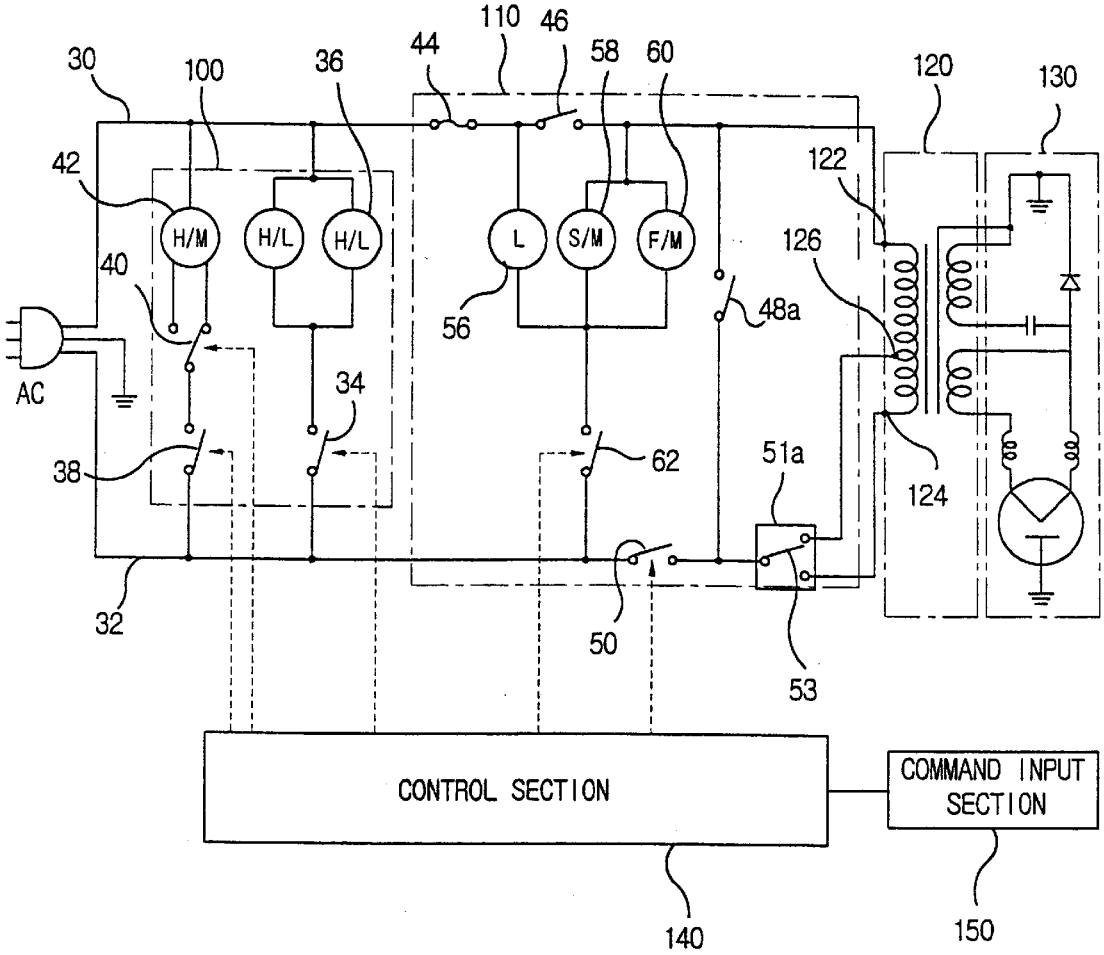

FIGS. 4 and 5 are circuit diagrams showing wall type microwave ovens according to another preferred embodiments of the present invention.

An another embodiment of the present invention shown in FIG. 4 is different from the one shown in FIG. 3 in that monitor switch 48*a* is provided at the front of third switch 51, while monitor switch 48 is provided behind third switch 51 as shown in FIG. 3. In addition, second switch 50 is provided between second common-use AC power line 32 and the other end 124 of the first coil. Second door switch 50 is turned to "on"/"off" state by a switching-control of control section 140 responding to the closing/opening of the door of cooking cavity.

FIG. 5 shows still another embodiment of the present invention. Difference of this embodiment from the one shown in FIG. 4 is that third switch 51*a* includes a double-contact points relay 53 which includes a pair of switch points, while third switch 51 provided behind monitor switch 48*a* in FIG. 4 includes first and second relays 52 and 54 which respectively have single-on/off contact point. In short, a double-contact points relay 53 can replace first and second relays 52 and 54.

Also, third switch 51 in FIG. 3, provided at the front of monitor switch 48 and having first and second relays 52 and 54, can replace second door switch 50 in FIGS. 4 and 5.

Figure 6:
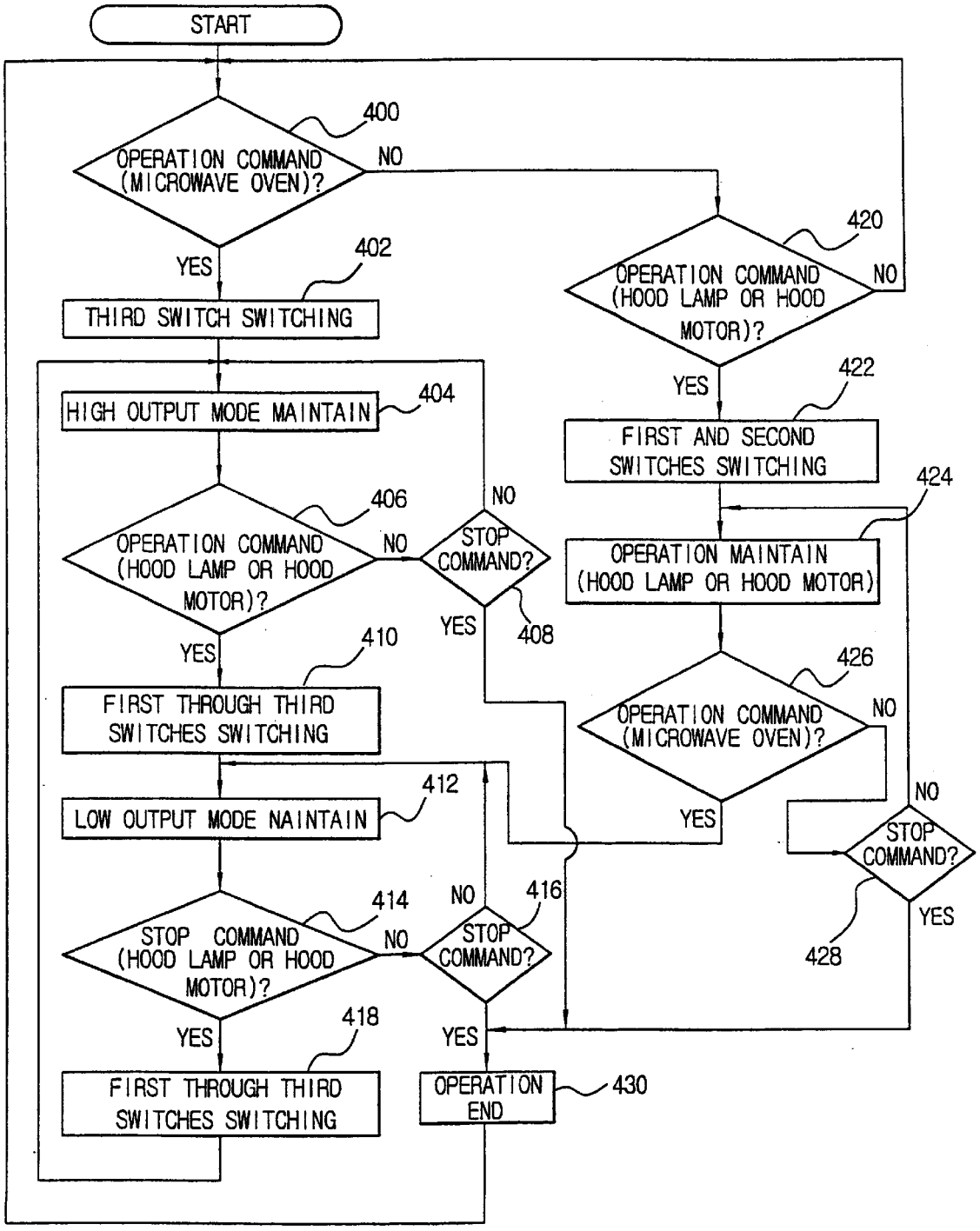
FIG. 6 is a flow chart for explaining an output controlling method of a wall type microwave oven according to the present invention.

FIG. 6 is a flow chart for explaining an output controlling method of a wall type microwave oven according to the present invention.

Hereinafter, the operation of the present invention will be described in greater detail with reference to the FIGS. 3 through 6.

Control section 140 checks if an operation command to the microwave oven is inputted (S400). If the operation command is inputted, control section 140 turns on first relay 52 of third switch 51, so that microwave oven is operated on a high output mode (S404).

During operation of microwave oven on a high output mode, control section 140 checks if an operation command to hood lamp 36 or hood motor 42 is inputted (S406). If not, control section 140 then checks if a stop command to the microwave oven is inputted (S408), and if not, control section 140 maintains S404.

But, if an operation command to hood lamp 36 or hood motor 42 is inputted in S406, control section 140 firstly switches first relay 52 of third switch 51 from "on" state to "off" state, first or second switch 38 or 34 from "off" state to "on" state, and then second relay 54 from "off" state to "on" state (S410). Accordingly, an output mode of the microwave oven is switched from the high level to the low one (i.e. overload prevention mode) and is maintained to the low level (S412).

Here, as second relay 54 is turned on, a voltage between one end 122 of the first coil and middle tap 126 corresponding to first relay 52 is expanded between both ends 122 and 124 of the first coil. Accordingly, a coil winding ratio with magnetron driving circuit section 130 relatively increases, the output of the microwave oven is decreased by the coil winding ratio. For better understanding, assuming that the coil winding ratio of the first coil and the second coil of high voltage transformer 120 is 1:2 and the winding number of the first coil increases by double, the coil winding ratio of the first and second coils becomes 2:2, and accordingly the output voltage of the second coil decreases by half.

Power supply section 110 could be overloaded by an increased electric current therethrough when hood lamp 36 or hood motor 42 is operated simultaneously with the microwave oven. This possible overload can be prevented by an increased winding number of the first coil as above described. That is, output of magnetron driving circuit section 130 decreases as much as the increased output amount of power supply section 110 which is increased by the operation of hood lamp 36 or hood motor 42. Accordingly, the output off-set effect is obtained, and thus a stable operation of the microwave oven can be realized.

After that, during the low output mode operation, the control section checks if an operation of hood lamp 36 or hood motor 42 is stopped (S414). And if hood lamp 36 or hood motor 42 is not stopped, the control section again checks if a stop command to the microwave oven is inputted (S416). If not, it maintains a low output mode in S412.

If the operation of hood lamp 36 or hood motor 42 is stopped in S414, control section 140 switches second relay 54 of third switch 51 from "on" state to "off" state, first or second switch 38 or 34 from "on" state to "off" state, and first relay 52 from "off" state to "on" state. As a result, the low output mode of the microwave oven is switched to the high level (S418), and the high output mode in S404 is maintained.

But if an operation command to the microwave oven is not inputted in S400, control section 140 checks if an operation command to hood lamp 36 or hood motor 42 is inputted. If not, control section 140 performs the S400, and if there is, it switches first or second switch 38 or 34 from "off" state to "on" state (S422), thereby operating hood lamp 36 or hood motor 42 and maintaining this operation state (S424).

As described above, control section 140 checks if an operation command to the microwave oven is inputted during the operation of hood lamp 36 or hood motor 42 (S426). If there is, control section 140 switches second relay 54 of third switch 51 from "off" state to "on" state, thereby operating the microwave oven on a low output mode of S412. Also, if neither an operation command to the microwave oven in S426 nor the stop command to the microwave oven after checking (S428) is inputted, control section 140 maintains S424.

Additionally, if a stop command to the microwave oven is inputted in steps 408, 416, and 428, control section 140 stops the operation of the microwave oven (S430), and then performs S400.

According to the present invention described as above, when the microwave oven and hood lamp, or the microwave oven and hood motor are operated at the same time, the microwave oven is directed to operate on a low output mode. And if the microwave oven alone is operated, it is operated on a high output mode. Consequently, total energy consumption for microwave oven can be controlled and overload is prevented. As a result, the wall type microwave oven can be designed as the one of high output.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A wall type microwave oven having a hood device, which comprises:

means for switching a power supply to a hood motor of said hood device and for switching the output of said microwave oven to a low or high level by varying a winding number of a first coil of a high voltage transformer;

means for controlling the output of said microwave oven by several stages; and a control section for switching/controlling said control means, responsive to a control of said switching means, such that when said microwave oven is operated with said hood motor, the output of said microwave oven is to be a low level.

2. A wall type microwave oven having a hood device, which comprises:

first switch means for switching a power supply to a hood motor of said hood device;

second switch means for switching power supply to a hood lamp of said hood device;

a third switch means for controlling the output of said microwave oven by several stages and for switching the output of said microwave oven to a low or high level by varying a winding number of a first coil of a high voltage transformer; and a control section for switching/controlling said third switch means, responsive to a control of said first or second switch means, such that when said microwave oven is operated with said hood motor or said hood lamp, output of said microwave oven is to be a low level.

3. The wall type microwave oven as claimed in claim 2, wherein said third switch means includes a first relay which is turned on under the high output, and a second relay which is turned on under the low output.

4. The wall type microwave oven as claimed in claim 3, wherein one end of said first relay is connected to a middle tap of the first coil of the high voltage transformer, and one end of said second relay is connected to one end of said first coil.

5. The wall type microwave oven as claimed in claim 2, wherein said third switch means includes a double-contact points relay which has each switch contact point for low or high output.

6. The wall type microwave oven as claimed in claim 2, wherein said third switch means switches said microwave oven to a high output mode when said microwave oven alone is operated.

7. The wall type microwave oven as claimed in claim 6, wherein said control section turns said third switch means to "off" state and said first or second switch means to "on" state, and controls said third switch means such that said microwave oven is switched to a low output mode, when a "turn-on" command to said hood lamp or said hood motor is inputted during an operation of said microwave oven alone.

8. A wall type microwave oven having a hood device, which comprises:

means for switching a power supply to a hood motor of said hood device;

means for controlling the output of said microwave oven by several stages; and a control section for switching/controlling said control means, responsive to a control of said switching means, such that when said microwave oven is operated with said hood motor, the output of said microwave oven is to be a low level.

9. A wall type microwave oven having a hood device, which comprises:

first switch means for switching a power supply to a hood motor of said hood device;

second switch means for switching power supply to a hood lamp of said hood device;

a third switch means for controlling the output of said microwave oven by several stages; and a control section for switching/controlling said third switch means, responsive to a control of said first or second switch means, such that when said microwave oven is operated with said hood motor or said hood lamp, output of said microwave oven is to be a low level.

10. The wall type microwave oven as claimed in claim 9, wherein said third switch means includes a first relay which is turned on under the high output, and a second relay which is turned on under the low output.

11. The wall type microwave oven as claimed in claim 10, wherein one endo of said first relay is connected to a middle tap of the first coil of the high voltage transformer, and one end of said second relay is connected to one end of said first coil.

12. The wall type microwave oven as claimed in claim 9, wherein said third switch means includes a double-contact points relay which has each switch contact point for low or high output.

13. The wall type microwave oven as claimed in claim 9, wherein said third switch means switches said microwave oven to a high output mode when said microwave oven alone is operated.

14. The wall type microwave oven as claimed in claim 13, wherein said control section turns said third switch means to an "off" state and said first or second switch means to an "on" state, and controls said third switch means such that said microwave oven is switched to a low output mode, when a "turn-on" command to said hood lamp or said hood motor is inputted during operation of said microwave oven alone.

* * * * *